US005469186A

United States Patent [19]

Tanaka et al.

[11] Patent Number: 5,469,186

[45] Date of Patent: Nov. 21, 1995

[54] DISPLAY DEVICE WITH FACE PLATE RESPONSIVE TO MULTIPLE WAVE LENGTH BEAMS

[75] Inventors: Satoru Tanaka; Fumio Matsui; Yasushi Murata, all of Saitama, Japan

[73] Assignee: Pioneer Electronic Corporation, Tokyo, Japan

[21] Appl. No.: 721,930

[22] Filed: Jun. 21, 1991

Related U.S. Application Data

[63] Continuation of Ser. No. 348,362, May 8, 1989, abandoned.

[30] Foreign Application Priority Data

| | | | |
|---|---|---|---|
| Jul. 15, 1988 | [JP] | Japan | 63-176653 |
| Jul. 15, 1988 | [JP] | Japan | 63-176654 |
| Jul. 17, 1988 | [JP] | Japan | 63-176652 |

[51] Int. Cl.[6] ..... G09G 5/00

[52] U.S. Cl. ..... 345/32; 340/815.43

[58] Field of Search ..... 340/701, 703, 340/720, 723, 815.07, 815.31, 766, 768, 770, 781, 815.43; 313/475, 496; 358/60, 16; 345/32

[56] References Cited

U.S. PATENT DOCUMENTS

| | | | |
|---|---|---|---|
| 2,553,182 | 5/1951 | Cage | 358/60 |
| 2,957,940 | 10/1960 | Cusano | 358/60 X |
| 3,534,153 | 10/1970 | Valensi | 358/16 |
| 3,826,944 | 7/1974 | Cooper | 313/475 |
| 4,264,408 | 4/1981 | Benham | 313/475 |
| 4,694,221 | 7/1987 | Rosier | 313/475 |
| 4,701,789 | 10/1987 | Bonye | 313/475 |
| 4,791,336 | 12/1988 | Morimoto et al. | 313/496 |

FOREIGN PATENT DOCUMENTS

| | | |
|---|---|---|
| 2645800 | 4/1978 | France . |
| 8016009 | 9/1980 | France . |
| 3301914 | 7/1984 | France . |
| 3434355 | 6/1986 | France . |
| 3546005 | 6/1986 | France . |
| 5489525 | 12/1977 | Japan . |
| 2057187 | 3/1981 | United Kingdom . |

OTHER PUBLICATIONS

"A Continuous Very–Large–Area Liquid–Crystal Color Display", Matsukawa et al. *SIO 85 Digest* pp. 58–61.

Lawrence E. Tannas, Jr., "Flat–Panel Displays and CRTs", copyright 1985, pp. 142–147, 157–160.

*Primary Examiner*—Richard Hjerpe

*Attorney, Agent, or Firm*—Sughrue, Mion, Zinn, Macpeak & Seas

[57] ABSTRACT

A planar display device having a fast display reaction time and which can have a large screen size but which is thin and light in weight. A face plate is provided which contains fluorescent materials sensitive to three different wavelengths of invisible ultraviolet rays and which emit light in red, green and blue colors in response to stimulation by rays of the three wavelengths. The three fluorescent materials may be stacked together in layers or mixed in a single layer with a binder, and a wavelength-converting layer may be employed.

17 Claims, 3 Drawing Sheets

DISPLAY DEVICE WITH FACE PLATE RESPONSIVE TO MULTIPLE WAVE LENGTH BEAMS

This is a continuation of application Ser. No. 07/348,362 filed May 8, 1989, now abandoned.

BACKGROUND OF THE INVENTION

The present invention relates to a display device suitable especially for an image display.

Conventionally, a CRT (cathode-ray tube), a liquid crystal panel, etc., are often used as a display device. However, in the case of a CRT, a vacuum system is needed and it is difficult to manufacture a CRT having a planar display face. Moreover, the device requires a large mounting depth. Further, it is difficult to make the screen of a CRT sufficiently large in size for many applications, and a high voltage is needed to operate the device. In contrast to this, in the case of a liquid crystal display device, the reaction speed with respect to the applied display drive signals is low and it is difficult to make the screen of the device large in size since the device is driven by an electric field.

SUMMARY OF THE INVENTION

Accordingly, an object of the present invention is to provide a display device which is light and easily formed in the shape of a plane and which can have a large screen size.

In accordance with the above and other objects, in accordance with one embodiment of the invention there is provided a display device having a face plate including a light emitting layer sensitive to invisible rays irradiated onto the light emitting layer.

Further, the invention provides a display device having a face plate including a light emitting layer which is sensitive to invisible rays of predetermined wavelengths and which emits light in respective colors, means for irradiating invisible rays onto the face plate, and wavelength converting means for converting the wavelengths of the invisible rays produced by the irradiating means to said predetermined wavelengths and guiding the invisible rays to the face plate.

Yet further in accordance with the invention, there is provided a display device having a light emitting face plate sensitive to invisible rays and irradiating means for irradiating the invisible rays onto the face plate. The face plate is constructed by mixing three kinds of fluorescent materials, which are sensitive to invisible rays of respective different wavelengths and which respectively emit red, green and blue light, in a powder state and molding these materials with a binding material.

DESCRIPTION OF THE PREFERRED EMBODIMENTS

Preferred embodiments of the present invention will now be described in detail with reference to the accompanying drawings.

Figure 1:
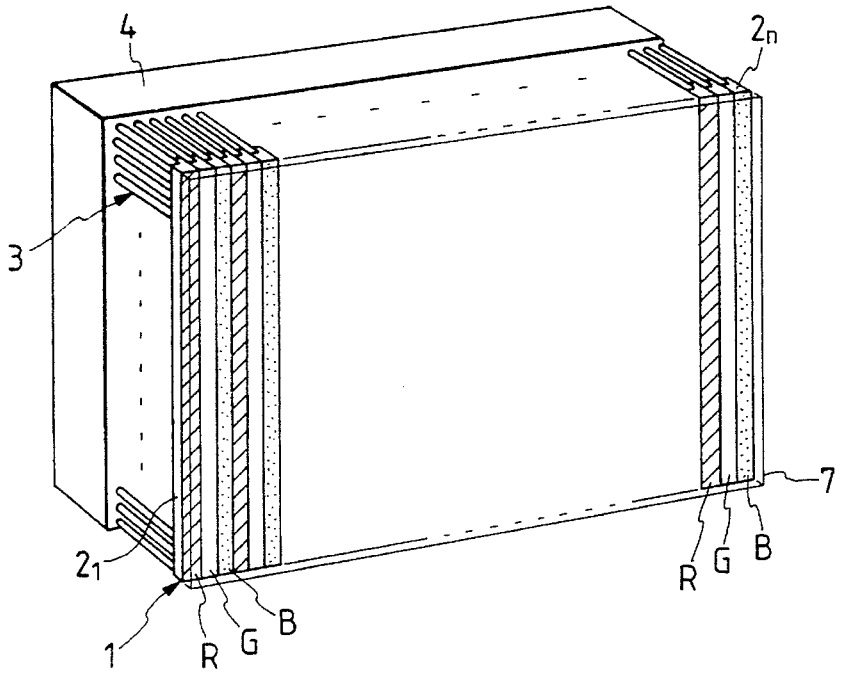
FIG. 1 is a schematic perspective view showing a first preferred embodiment of a display device of the present invention.

FIG. 1 is a schematic perspective view showing a first preferred embodiment of a display device constructed in accordance-with the present invention. In this figure, a face plate 1 is constructed of a plurality of columnar members $\mathbf{2}_1$ to $\mathbf{2}_n$ (where n is a multiple of 3) sequentially arranged on a plane and having an L-shape in cross section. A light emitting layer is formed on the display face sides of the respective columnar members $\mathbf{2}_1$ to $\mathbf{2}_n$ by repeatedly coating them with three kinds of fluorescent materials respectively sensitive to invisible rays of three different wavelengths and respectively emitting red, green and blue light. The three fluorescent materials are arranged in a sequential coating order of red (R), green (G) and blue (B) colors. Suitable fluorescent materials are sold under the trade name "Lumilight color" manufactured by Sinroihi Co., Ltd., of Japan, for example. With these materials, red emission is performed by an yttrium oxide system, green emission is performed by a zinc oxide-germanium oxide system, and blue emission is performed by a boron oxide-calcium system.

Ultraviolet rays having excitation wavelengths $\lambda_1$, $\lambda_2$ and $\lambda_3$ different from each other (e.g., $\lambda_1$=360 nm, $\lambda_2$=330 nm and $\lambda_3$=300 nm) are used as the invisible rays. A source 4 which sequentially generates ultraviolet rays in these wavelengths is irradiated as a light spot onto each of the columnar members $\mathbf{2}_1$ to $\mathbf{2}_n$ by optical fiber bundles 3 arranged corresponding to the picture elements. The ultraviolet ray generating source 4 is constructed by, e.g., two polygonal mirrors in the shape of a polygonal prism arranged perpendicular to each other so as to two-dimensionally scan the ultraviolet light spot. The scanning operation is sequentially performed by activating the respective excitation rays of excitation wavelengths $\lambda_1$, $\lambda_2$ and $\lambda_3$ in response to R, G and B signals.

Figure 2:
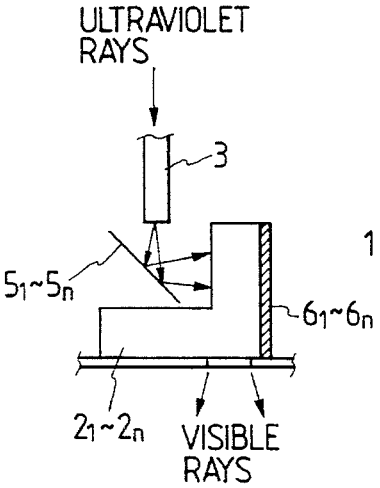
FIG. 2 is a plan view showing the construction of a portion for irradiating ultraviolet rays in the display device of FIG. 1.

As shown in FIG. 2, mirrors $\mathbf{5}_1$ to $\mathbf{5}_n$ are disposed on the light emitting sides of the respective optical fibers of the optical fiber bundles 3 such that the ultraviolet rays irradiated onto the face plate 1 are not directly transmitted onto the columnar members $\mathbf{2}_1$ to $\mathbf{2}_n$ on the display face side. That is, the advancing direction of the ultraviolet rays is changed to a perpendicular direction by the mirrors $\mathbf{5}_1$ to $\mathbf{5}_n$ so as to direct the ultraviolet rays onto columnar members $\mathbf{2}_1$ to $\mathbf{2}_n$ from the sides thereof. Namely, the light receiving and emitting portions of the face plate 1 are arranged to be offset from each other with respect to a direction parallel to the display face. Layers $\mathbf{6}_1$ to $\mathbf{6}_n$ for interrupting the ultraviolet rays and which are opaque with respect to the ultraviolet rays are disposed between columnar members $2_1$ to $2_n$, and a layer 7 for interrupting the ultraviolet rays is also disposed on the display face side of the face plate 1.

In the display device constructed as described above, the light emitting layer sensitive to the ultraviolet rays different in wavelength from each other and emitting light in respective different colors is formed in a striped pattern on the display face of the face plate 1, and the scanning operation is sequentially performed by the light spot. Accordingly, the device permits a display speed which can sufficiently follow the display of a moving picture. Further, since the face plate 1 can be made thin and light, the entire device can easily manufactured in the shape of a plane, and a large-sized screen can readily be manufactured. Moreover, since the device is constructed such that the ultraviolet rays are guided by the optical fiber bundles 3 to the face plate 1, the ultraviolet ray generating source 4 need not necessarily be disposed to the rear of the face plate 1, whereby the entire device can be made thin.

Figure 3:
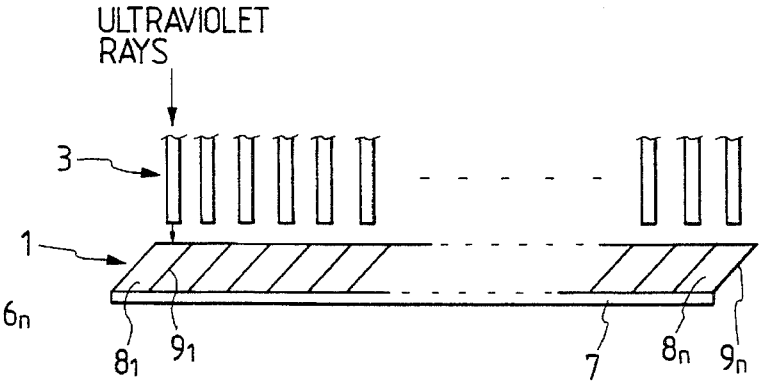
FIG. 3 is a sectional plan view showing another embodiment of the device of the present invention.

In the above-described embodiment, the face plate 1 is constructed by sequentially arranging plural columnar members $2_1$ to $2_n$ having an L-shape in cross section on a plane. However, as shown in FIG. 3, the face plate 1 may be constructed by alternately arranging a plurality of columnar members $8_1$to $8_n$ having the shape of a parallelogram in cross section through layers $9_1$ to $9_n$ for interrupting the ultraviolet rays. Namely, the effects of the present invention can be obtained if the light receiving and emitting portions of the face plate 1 are arranged to be offset to each other with respect to a direction parallel to the display face such that the ultraviolet rays are not directly transmitted onto the display face side.

In FIG. 3, the light emitting end faces of the optical fiber bundles 3 are shown for clarity of illustration as being separated from the face plate 1, but these members should actually be closely adjacent to each other. Similarly, the respective fibers are shown as being separated from each other, but actually should be in close contact with each other.

Further embodiments of the present invention will now described in detail with reference to FIGS. 4 and 5 of the drawings.

Figure 4:
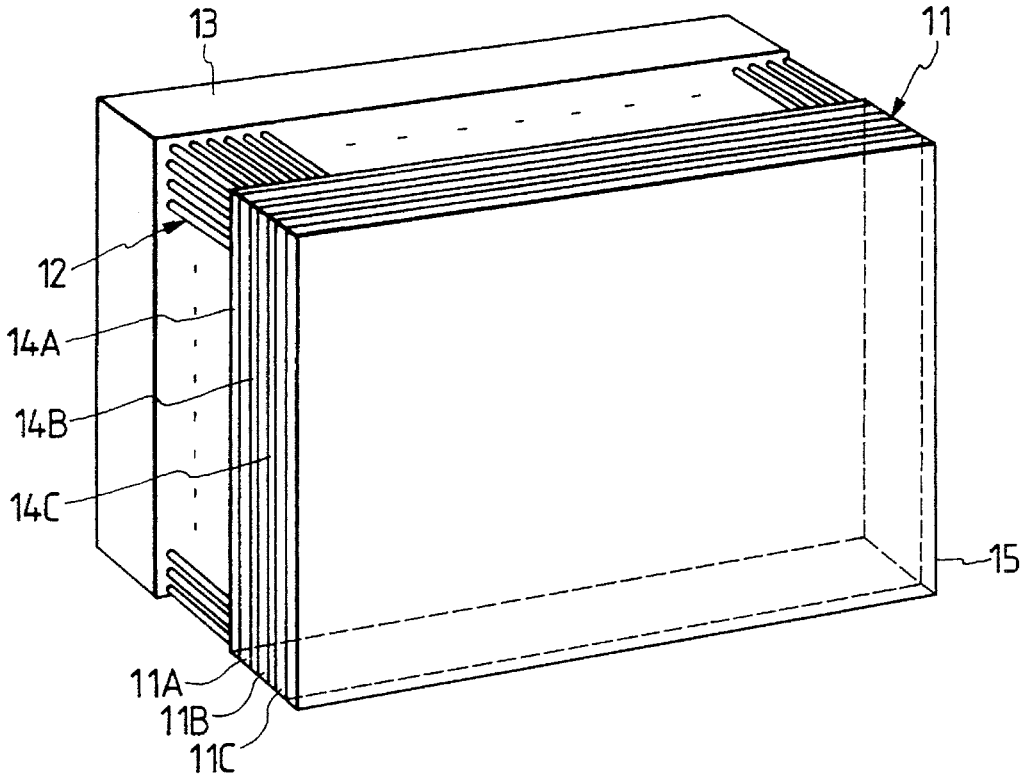
FIG. 4 is a schematic perspective view showing still another embodiment of a display device of the present invention.
Figure 5:
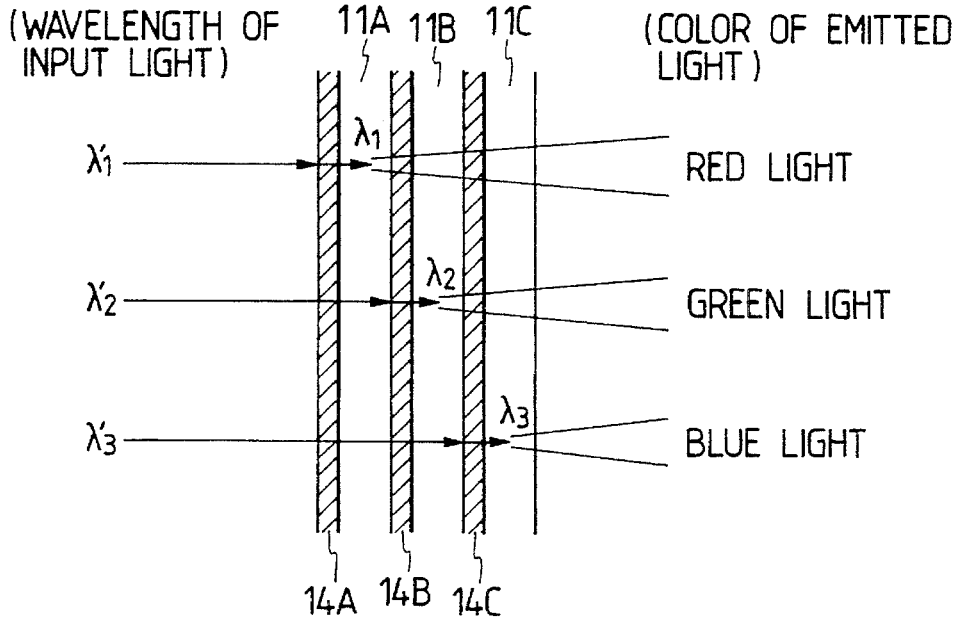
FIG. 5 is a cross-sectional view of a portion of the display device of FIG. 4 illustrating wavelength conversion and light emitting states in the face plate of the device with respect to excitation wavelengths $\lambda_1$, $\lambda_2$ and $\lambda_3$.

FIG. 4 is a schematic perspective view showing another embodiment of a display device of the present invention. In this figure, a face plate 11 is constructed of three stacked parallel plates 11A, 11B and 11C, which are respectively formed by three kinds of fluorescent materials, each of which is sensitive to a different wavelength of invisible rays. The plates 11A, 11B and 11C respectively emit red, green and blue light when excited by invisible rays of the appropriate wavelength. The plates 11A, 11B and 11C are formed, for example, by molding a mixture of powdered fluorescent materials with a binding material such as a resin in the shape of a plate. The types of fluorescent materials mentioned above may be used and, also as above, ultraviolet rays having excitation wavelengths $\lambda_1$, $\lambda_2$ and $\lambda_3$ (e.g., $\lambda_1$=360 nm, $\lambda_2$=330 nm and $\lambda_3$ =300 nm) different from each other can be used.

A source 13 for generating the ultraviolet rays sequentially irradiates the ultraviolet rays as a light spot onto a face plate 11 through optical fiber bundles 12 arranged corresponding to picture elements. The ultraviolet ray generating source 13 includes three light sources respectively generating ultraviolet rays having three different wavelengths $\lambda_1'$, $\lambda_2'$ and $\lambda_3'$ corresponding to excitation wavelengths $\lambda_1$, $\lambda_2$ and $\lambda_3$. For example, two polygonal mirrors having the shape of a polygonal prism arranged perpendicular to each other can be used to two-dimensionally scan the light spot of ultraviolet rays over the face plate 11. The scanning operation is sequentially performed so as to emit light in wavelengths of $\lambda_1'$, $\lambda_2'$ and $\lambda_3'$ in response to R, G and B signals.

With respect to face plate 11, wavelength converting films 14A, 14B and 14C are disposed on the light receiving sides of respective ones of the plates 11A, 11B and 11C. The wavelength converting films 14A, 14B and 14C respectively convert wavelengths $\lambda_1'$, $\lambda_2'$ and $\lambda_3'$ of the incident light to excitation wavelengths $\lambda_1$, $\lambda_2$ and $\lambda_3$. These wavelength converting films are stacked upon the respective plates 11A, 11B and 11C. An ultraviolet ray interrupting layer 15 for blocking ultraviolet rays is disposed on the display face side of the face plate 11.

In the display device constructed as described above, as shown in FIG. 5, when ultraviolet rays having wavelengths $\lambda_1'$, $\lambda_2'$ and $\lambda_3'$ are sequentially irradiated in the form of a light spot onto the face plate 11 through the optical fiber bundles 12, the incident light of wavelength $\lambda_1'$, $\lambda_2'$ or $\lambda_3'$ is converted to light of excitation wavelength $\lambda_1$, $\lambda_2$ or $\lambda_3$ by a respective one of the waveform converting films 14A, 14B or 14C, and thereafter the wavelength-converted light is made incident onto the plates 11A, 11B and 11C. Thus, the one of the plates 11A, 11B and 11C sensitive to the excitation light of excitation wavelength $\lambda_1$, $\lambda_2$ or $\lambda_3$ is excited, thereby emitting light in a color corresponding to the excitation wavelength $\lambda_1$, $\lambda_2$ or $\lambda_3$.

As described above, in this embodiment of the inventive display device, the wavelength $\lambda_1'$, $\lambda_2'$ or $\lambda_3'$ of the ultraviolet rays produced by the ultraviolet ray generating source 13 is converted by a respective one of the wavelength converting films 14A, 14B and 14C to an excitation wavelength $\lambda_1$, $\lambda_2$ or $\lambda_3$, and the resulting ultraviolet rays are guided to the face plate 11 sensitive to ultraviolet rays of an excitation wavelength $\lambda_1$, $\lambda_2$ or $\lambda_3$, resulting in emission of light of the desired color. Accordingly, the wavelength of the light source can be freely selected. Further, since the scanning operation of the face plate 11 is sequentially performed by the excitation light spot, the display device of the invention provides a display speed sufficiently high as to following a moving picture. Moreover, since the size of the picture element is determined by the size of the spot of the excitation light, a desired minimum picture element size can be readily obtained. Further, since the face plate 11 can be made thin and light, the entire device can easily be formed in the shape of a plane and a large screen size obtained. Since the ultraviolet rays are guided to the face plate 11 by the optical fiber bundles 12, the ultraviolet ray generating source 13 need not necessarily be disposed behind the face plate 11 so that the entire device can be made thin.

In the above-discussed embodiment, three plates 11A, 11B and 11C are respectively formed using three kinds of fluorescent materials and are stacked with each other to constitute the face plate 11. Further, wavelength converting films 14A, 14B and 14C are arranged on the light receiving sides of respective ones of the plates 11A, 11B and 11C. However, as will be described below in more detail, a single face plate 11 can be constituted by mixing the three kinds of fluorescent materials with a resin and molding the mixture in the shape of a plate. Moreover, the converting films 14A, 14B and 14C can be stacked with each other on the light receiving side of the face plate 11.

Still further embodiments of the present invention will now be described in detail with reference to FIGS. 6 through 8 of the drawings.

Figure 6:
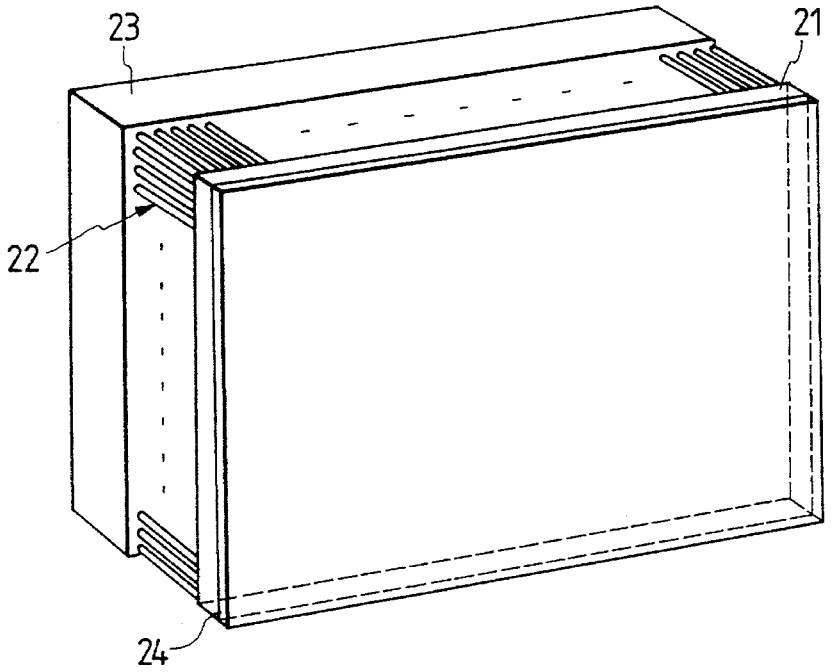
FIG. 6 is a schematic perspective view showing yet another embodiment of a display device of the present invention.

FIG. 6 is a schematic perspective view showing another preferred embodiment of a display device of the present invention. In this embodiment, a light emitting face plate 21 is constructed by mixing three kinds of fluorescent materials, which are respectively sensitive to three different wavelengths and emitting red, green and blue light, in a powder state with a binding material such as a resin, and molding these materials in the shape of a plate. The same fluorescent materials mentioned above can be used. It is necessary that the respective excitation wavelengths $\lambda_1$, $\lambda_2$ and $\lambda_3$ of the three fluorescent materials be strongly independent of each other.

Similar to the above-described embodiments, a source 23 is provided for generating ultraviolet rays of the three different wavelengths sequentially and irradiating the ultraviolet rays as a light spot onto the face plate 21 through optical fiber bundles 22 arranged corresponding to picture elements. An ultraviolet ray interrupting layer 24 for blocking ultraviolet rays is disposed on the display face side of the face plate 21.

Figure 7:
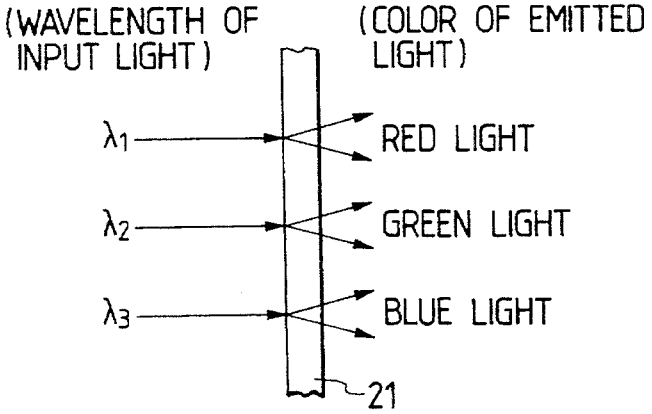
FIG. 7 is a cross-sectional view of a portion of the face plate of the display device of FIG. 6 showing a light emitting state of the face plate with respect to excitation wavelengths $\lambda_1$, $\lambda_2$ and $\lambda_3$.
Figure 8:
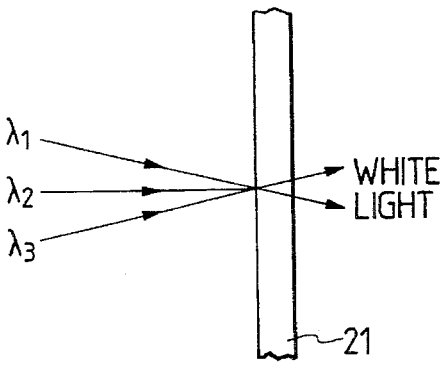
FIG. 8 is a view similar to that of FIG. 7 but illustrating the case in which white light is emitted.

In the device constructed as described above, when the excitation light spot is sequentially irradiated onto the face plate 21 through the optical fiber bundles 22, one of the three fluorescent materials mixed in the face plate 21 corresponding to the excitation wavelength $\lambda_1$, $\lambda_2$ or $\lambda_3$ is excited so that light in a corresponding color is emitted, as shown in FIG. 7. When excitation rays of all three excitation wavelengths $\lambda_1$, $\lambda_2$ and $\lambda_3$ are irradiated and concentrated onto the same spot as shown in FIG. 8, white light is emitted from the picture element.

This embodiment achieves the same advantages as the above-discussed embodiments.

What is claimed is:

1. A display device comprising: a face plate comprising a light emitting layer having multiple columnar members, adjacent members of which are sensitive to different wavelength invisible rays, said face plate emitting light in a plurality of different colors in response to said different wavelength invisible rays, respectively; and means for selectively irradiating said light emitting layer with each of said different wavelength invisible rays; wherein each of said multiple columnar members has a parallelogram shaped cross-section with light receiving and emitting portions on opposite ends thereof, such that an axis of said parallelogram running between light receiving and emitting portions is not perpendicular to said face plate, to prevent invisible rays from being transmitted directly through the columnar member.

2. The display device as claimed in claim 1, wherein said irradiating means comprises means for sequentially generating each of said invisible rays of different wavelengths as a light spot onto said light emitting layer.

3. The display device as claimed in claim 1, wherein said multiple columnar members have light receiving and light emitting portions and an L-shaped cross section to prevent the invisible rays from being transmitted directly between the light receiving and light emitting portions.

4. The display device as claimed in claim 3, said face plate including multiple mirrors that direct the invisible rays onto said light receiving portions, said light receiving and emitting portions being offset from each other with respect to a direction parallel to a display face.

5. The display device of claim 1 further comprising an interrupting layer for blocking ultraviolet rays disposed on a display face side of the face plate.

6. The display device of claim 1, further including a plurality of optical fibers arranged to transmit invisible rays between the irradiating source and the light emitting layer, wherein a single column of optical fibers transmits invisible rays onto each columnar member.

7. A display device comprising: a face plate sensitive to different wavelength invisible rays, said face plate emitting light in a plurality of different colors, each of which is emitted in response to a corresponding one of said different wavelength invisible rays, said face plate having multiple excitation wavelengths, that differ from said invisible ray wavelengths; means for producing said different wavelength invisible rays; and at least one wavelength converting means for converting said different wavelength invisible rays to rays of said respective excitation wavelengths and allowing each of the converted rays to be directed to any position upon said face plate, wherein said face plate produces any of said different colors at any position based on which of said excitation rays is directed at said position.

8. The display device as claimed in claim 7, wherein said means for producing invisible rays comprises means for sequentially producing a light spot with each of said invisible rays to scan said face plate through said wavelength converting means.

9. The display device as claimed in claim 7, wherein said face plate comprises three plates formed of three respective kinds of fluorescent materials sensitive to excitation rays of respective different wavelengths and respectively emitting light in red, green and blue colors, said three plates being stacked parallel to each other, said wavelength converting means including three wavelength converting films disposed on a light receiving side of said three plates, each of said converting films converting a different wavelength invisible ray into a corresponding excitation ray.

10. The display device as claimed in claim 7, wherein said wavelength converting means comprises a layer for changing the wavelength of one of said invisible rays, said layer disposed on a light receiving side of said face plate.

11. The display device of claim 7 further comprising an interrupting layer for blocking ultraviolet rays disposed on a display face side of the face plate.

12. A display device comprising: a face plate sensitive to different wavelength invisible rays, said face plate emitting light in a plurality of different colors, wherein each color is emitted in response to a corresponding one of said different wavelength invisible rays; said face plate comprising a plurality of fluorescent materials uniformly mixed together, each of said fluorescent materials being sensitive to a different one of said different wavelength invisible rays and emitting light in a respective different color; and means for producing invisible rays of said different wavelengths, wherein each of said different colors is producible at every position upon said face plate based on which of said different wavelength invisible rays irradiates said position.

13. The display device of claim 12, wherein said fluorescent materials are mixed together in a powder state with a binder to form a single integral plate.

14. The display device of claim 12, wherein three fluorescent materials are mixed together to emit light in red, green and blue colors, respectively.

15. The display device as claimed in claim 12, wherein said means for producing invisible rays comprises means for sequentially irradiating invisible rays of different wavelengths as a light spot on said face plate.

16. The display device of claim 12 further comprising an interrupting layer for blocking ultraviolet rays disposed on a display face side of the face plate.

17. The display device of claim 12, further comprising optical fibers positioned between said face plate and said invisible ray producing means to transmit the different wavelength invisible rays between light receiving and emitting portions of the optical fibers.

* * * * *